US005548867A

United States Patent [19]

Hwang et al.

[11] Patent Number: 5,548,867

[45] Date of Patent: Aug. 27, 1996

[54] VIBROISOLATING APPARATUS OF VACUUM CLEANER

[75] Inventors: Jin-Sung Hwang, Anyang; Jin-Seung Sohn, Seoul, Rep. of Korea

[73] Assignee: Samsung Electronics Co., Ltd., Suwon, Rep. of Korea

[21] Appl. No.: 397,989

[22] Filed: Mar. 3, 1995

[30] Foreign Application Priority Data

Mar. 3, 1994 [KR] Rep. of Korea ..... 94-4046 U
May 26, 1994 [KR] Rep. of Korea ..... 94-11836 U

[51] Int. Cl.[6] ..... A47L 9/22

[52] U.S. Cl. ..... 15/339; 15/326; 15/412; 417/363

[58] Field of Search ..... 15/412, 339, 326; 417/363

[56] References Cited

U.S. PATENT DOCUMENTS 4,597,131 7/1986 Lyman ..... 15/412 X
4,632,642 12/1986 Meister et al. ..... 15/412 X
4,746,092 5/1988 Hayashi et al. ..... 15/412 X
4,864,683 9/1989 Herron et al. ..... 15/412
5,293,664 3/1994 Lim et al. ..... 15/412 X

*Primary Examiner*—Chris K. Moore
*Attorney, Agent, or Firm*—Burns, Doane, Swecker & Mathis, L.L.P.

[57] ABSTRACT

The present invention relates to a vibroisolating apparatus for a vacuum cleaner adapted to absorb and inhibit the vibrations generated in a suction motor from being transmitted to a body of the vacuum cleaner to thereby reduce the noise resulting from the vibration to a minimum, and at the same time, to improve the ease of assembling and to decrease manufacturing cost by way of a simplified construction. The vibration generated in the suction motor during operations is absorbed and inhibited at a front side of the motor by a vibroisolating ring which is tightly disposed between a front motor case and the suction motor. The vibration is also absorbed and inhibited at a rear side of the motor by the rear surface packing which is disposed between a rear motor case and the motor. The apparatus thereby reduces generation of noise resulting from the vibration of the suction motor to a minimum and provides for relatively silent operation of the vacuum cleaner.

8 Claims, 6 Drawing Sheets

VIBROISOLATING APPARATUS OF VACUUM CLEANER

BACKGROUND OF THE INVENTION

1. Field of the Invention

The present invention relates to a vaccum cleaner adapted to perform cleaning by absorbing foreign objects such as dust and the like by way of suction force generated in accordance with operation of a suction motor, and more particularly to a vibroisolating apparatus of a vacuum cleaner for absorbing and interdicting vibration generated in the suction motor to thereby minimize generation of noise resulting therefrom.

2. Description of the Prior Art

Generally, it should be recognized that a vacuum cleaner generates deafening noise and vibration according to operation of a suction motor for generating strong suction force.

The noise generated at this time can be reduced to some extent by way of a sound absorption material and the like. However, the vibration inherently generated from the suction motor itself is transmitted to surroundings thereof directly and indirectly to thereby become a noise source for generating an excessive intensity of noise, so that a remedy for that noise is sought after.

In Japanese utility model application Showa 62-37554, a vacuum cleaner is disclosed to prevent vibration generated from a suction motor from being propagated to surroundings thereof.

The vacuum cleaner disclosed in the Japanese application Showa 62-37554 is illustrated in FIG. 1 where the vacuum cleaner is combined at one side of a body 1 thereof with a dust collecting chamber 2 mounted with a suction inlet 2*a*, and is provided at the other side of the body 1 thereof with a suction motor 3 for generating suction force according to operation of the vacuum cleaner.

The dust collecting chamber 2 is inherently arranged at an inside thereof with a filtering apparatus 4.

The suction motor 3 is fixedly disposed within a motor case 5, a front side of which is provided with a front surface buffering rubber 6 and a rear side of which is arranged with a rear surface buffering rubber 7 to thereby maintain a fixed balanced condition.

The suction motor 3 is disposed at a periphery thereof with a vibroisolating material 8 encased within the motor case 5 so that the noise generated therefrom cannot be transmitted.

The body 1 of the vacuum cleaner is formed at a rear surface with a discharge hole 9 for discharging absorbed air out to the atmosphere.

Accordingly, the suction force generated in accordance with the operation of the suction motor 3 absorbs the air along with dust and other foreign objects through a suction inlet body (not shown), and at this time, the dust and the like are filtered by the filtering apparatus 4 to thereafter be stored in a dust collecting chamber 2. Purified air which has passed the filtering apparatus 4 is discharged out to the atmosphere through the discharge hole 9 to thereby complete the cleaning works.

However, there are lots of problems in that, the conventional vacuum cleaner thus constructed has the suction motor for generating the suction force fixedly supported by front, side and rear surface buffering rubbers to thereby cause the suction motor and the motor case to produce a wide range of contact surface with the front and rear surface buffering rubbers, so that the vibration generated therefrom is transmitted to the motor case and the body of the vacuum cleaner through the front and rear surface buffering rubbers, and consequently, noisy vibration and noise are generated therefrom and at the same time, structure thereof becomes complicated to thereby decrease productivity and to increase manufacturing cost.

A vibroisolating apparatus for minimizing the transmissiion of the vibration generated from the suction motor of the conventional vacuum cleaner is illustrated in FIG. 2, where the suction motor 3 arranged within the motor case 5 is insertedly disposed at a front side thereof with a front packing 10, and is fixedly provided at a rear surface thereof with a first rear packing 11 formed outside thereof with an air induction plate 11*a*.

The motor case 5 is fixed at a rear surface end thereof to an inner side of the body 1 through the intermediary of a second rear packing 12.

However, there are other problems in that, even though the vibroisolating apparatus of the conventional vacuum cleaner thus constructed can reduce to some extent the noise generated according to flow of the absorbed air, the vibration generated in the suction motor is transmitted into the motor case through the front packing, first rear and second rear packings adapted to contact directly with the motor case. The transmission of vibrations through the packings makes it difficult to expect a satisfactory vibroisolating effect and to reduce an assembly efficiency due to structural complication.

SUMMARY OF THE INVENTION

The present invention is disclosed to solve the aforesaid problems of the prior art, and it is an object of the present invention to provide a vibroisolating apparatus for a vacuum cleaner which is adapted to generate minimum noise resulting from vibration by absorbing and interdicting the vibration generated from a suction motor so that the vibration is prevented from being transmitted to a body of the vacuum cleaner.

In accordance with the object of the present invention, there is provided a vibroisolating apparatus for a vacuum cleaner mounted with a body and a suction motor for generating suction force within the body to absorb the dust and other foreign objects and to thereby perform the cleaning works, the apparatus comprising:

- a motor case adapted to be inherently disposed with the suction motor;
- a vibroisolating ring and a rear surface packing provided at front and rear surfaces of the suction motor to thereby absorb and inhibit the vibration generated at the suction motor from being transmitted to the motor case; and
- a front surface packing arranged at an external front side of the motor case to thereby absorb and inhibit the vibration from being transmitted to a body of the vacuum cleaner.

Accordingly, because the suction motor is fixedly disposed through the intermediary of the vibroisolating ring and rear surface packing at the front and rear surfaces in the motor case, and at the same time, because the motor case is supported in the body at both ends thereof by the front surface packing and the rear surface packing, the vibration generated from the suction motor is absorbed and interdicted by the vibroisolating ring, and front and rear surface packings to minimize transmission of the vibration, and to thereby realize a minimized generation of the vibration resulting therefrom.

Because of the minimized generation of vibration, quiet operation is possible and because of a simple structure, assembly thereof is simplified and manufacturing costs are remarkably reduced.

BRIEF DESCRIPTION OF THE DRAWINGS

Other objects and aspects of the invention will become apparent from the following description of embodiments with reference to the accompanying drawings in which.

DETAILED DESCRIPTION OF THE INVENTION

Figure 1:
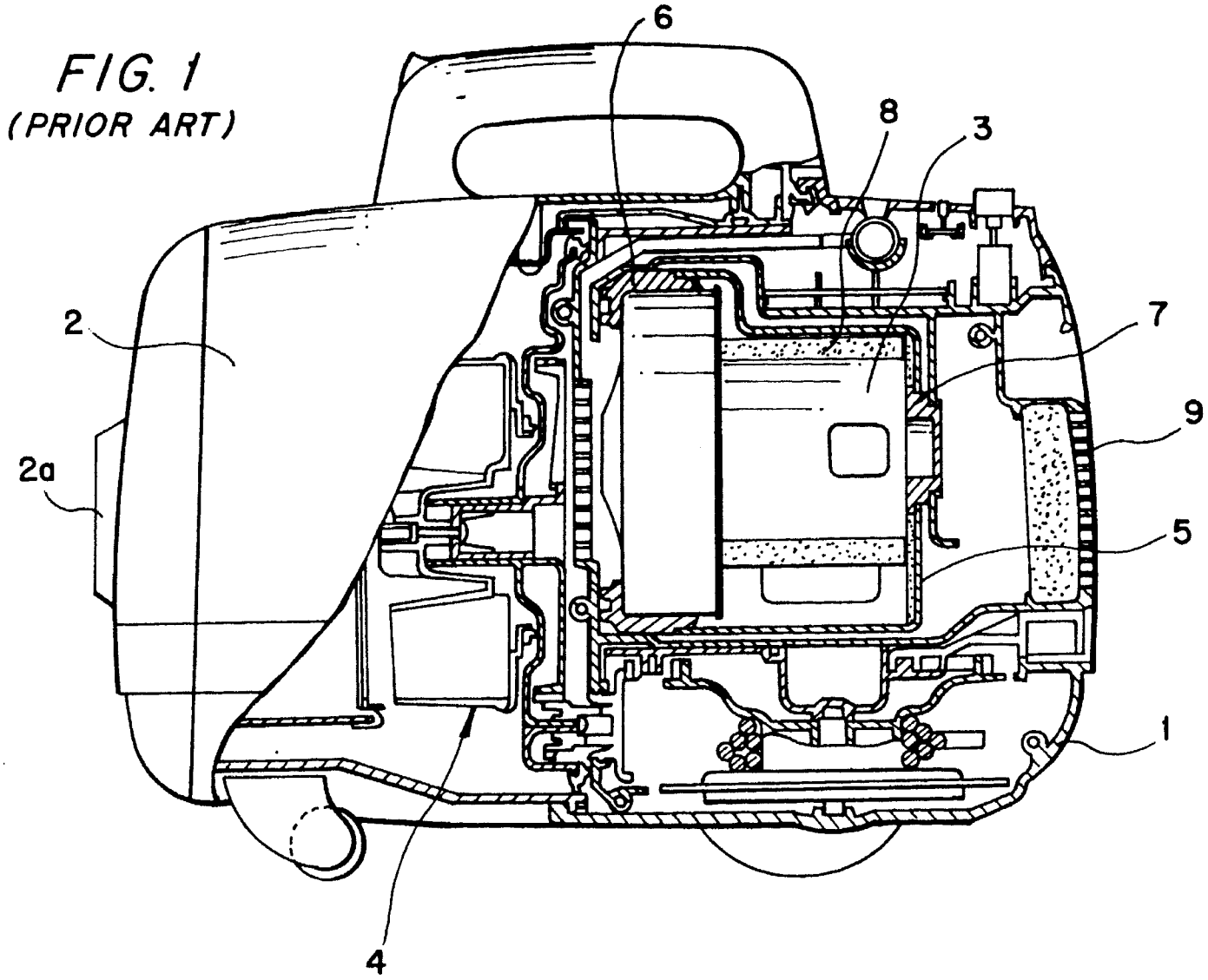
FIG. 1 (PRIOR ART)
FIG. 1 is a sectional view illustrating a partial cutaway state of one embodiment according to a vibroisolating apparatus of a conventional vacuum cleaner.
Figure 2:
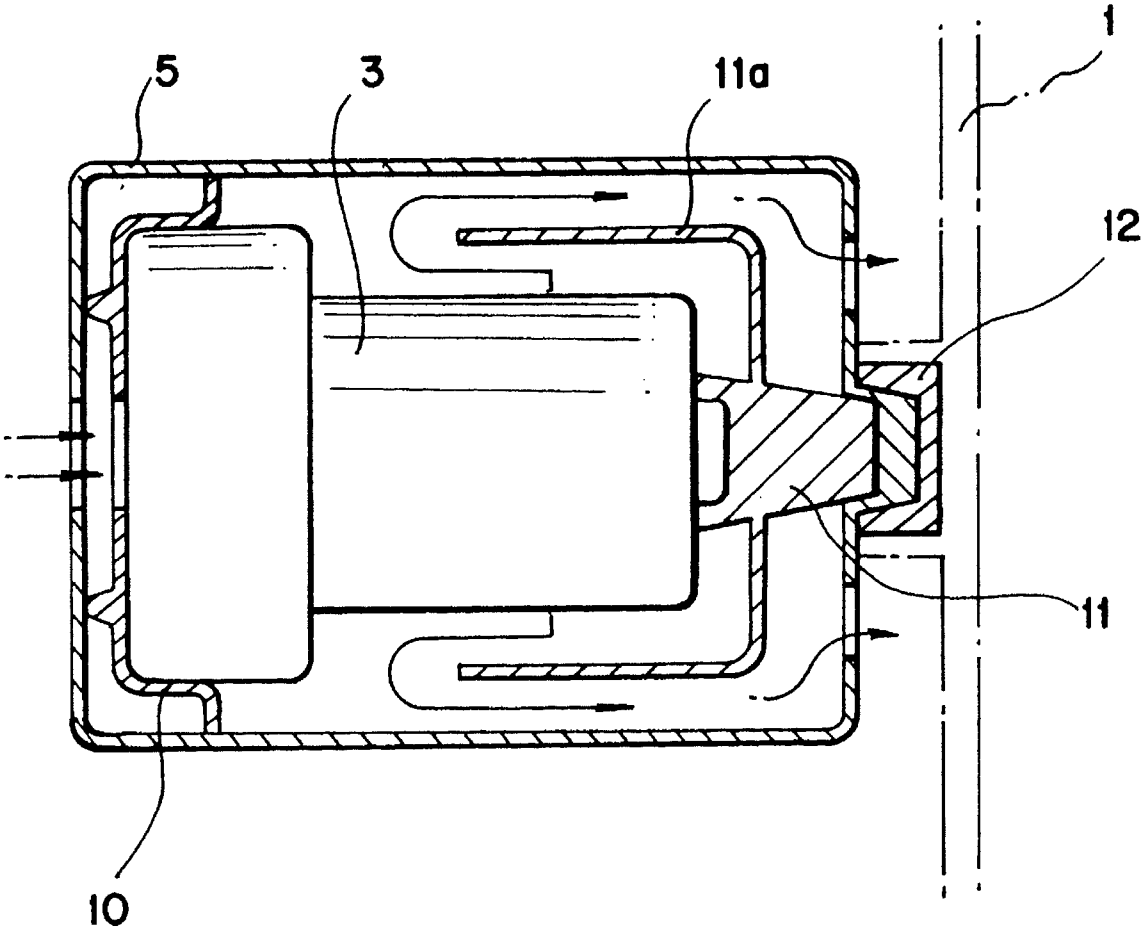
FIG. 2 (PRIOR ART)
FIG. 2 is a partial longitudinal sectional view illustrating another embodiment of a vibroisolating apparatus according to a conventional vacuum cleaner.
Figure 3:
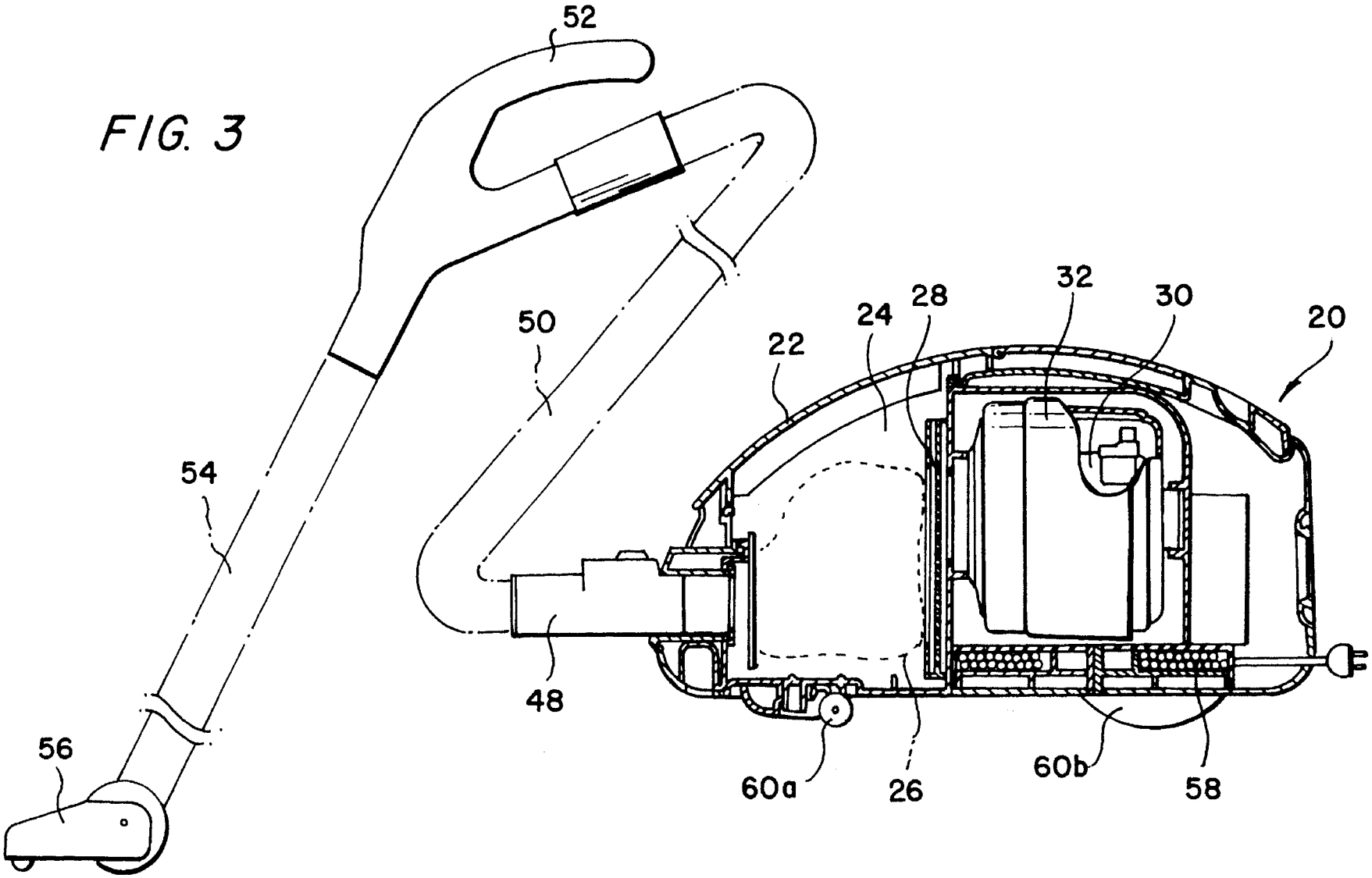
FIG. 3 is a sectional view illustrating a partial cutway state of one embodiment for a vibroisolating apparatus of a vacuum cleaner according to the present invention.

Perferred embodiments of the present invention will now be described in detail with reference to the accompanying drawings in FIGS. 3 and 4.

Reference numeral 20 in the drawings denotes a body of the vacuum cleaner mounted at a top side thereof with a lid 22.

A dust collecting chamber 24 formed inside the body 20 is assembled as a releasable fitting on a dust collecting pocket 26 for internally storing the dust and other foreign objects.

The dust collecting chamber 24 is disposed at one side thereof with a filtering member 28 for inhibiting passage of fine dust and the like contained in the air which have passed the dust collecting pocket The dust collecting chamber 24 is provided at one side thereof with a suction motor 30 encased within a motor case 32 in order to generate suction force according to operation for absorption of the air along with the dust and other foreign objects, and the suction motor 30 is formed at a front side thereof with a ring protruder 30*a*.

Figure 4:
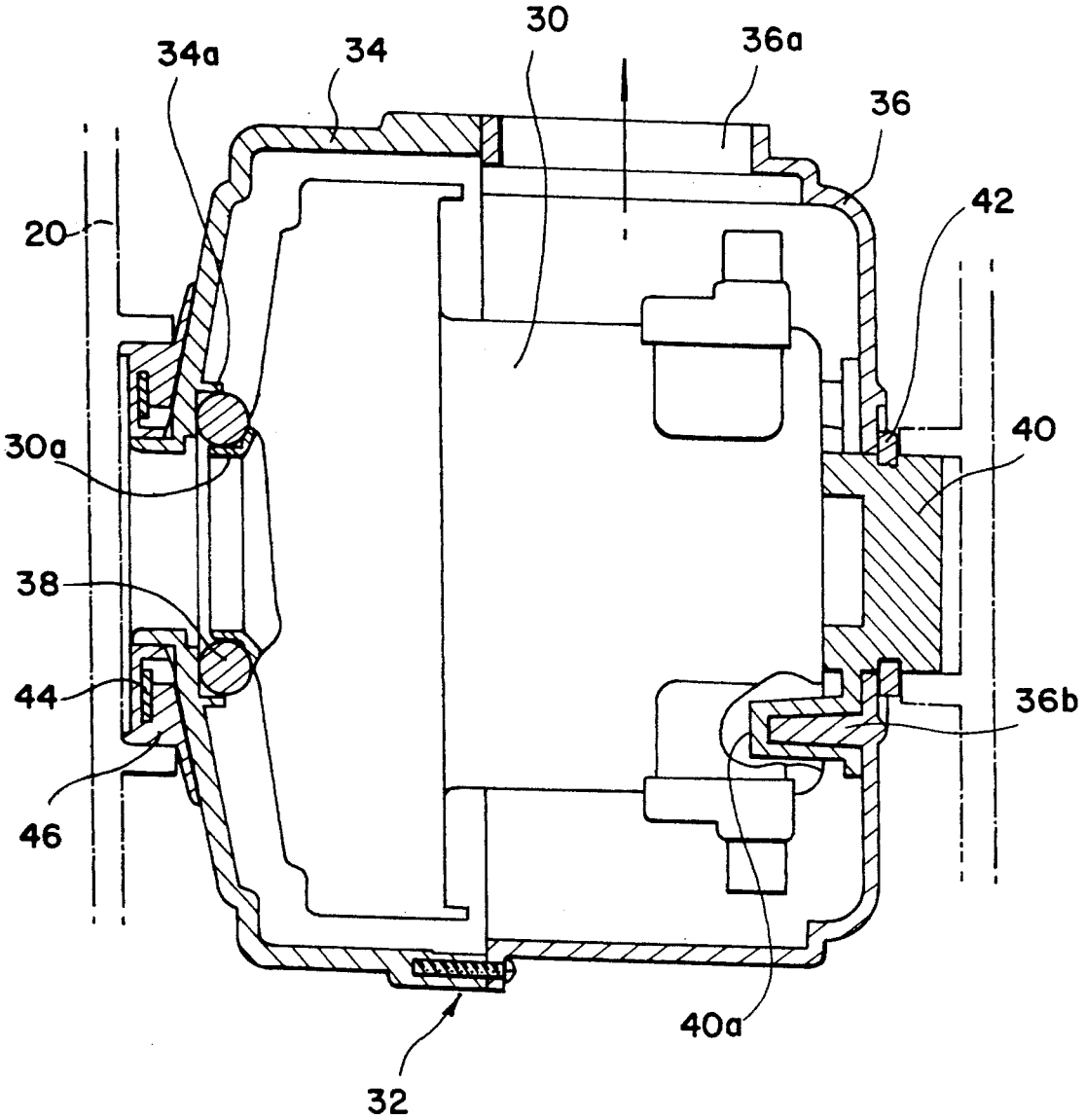
FIG. 4 is an enlarged sectional view of principal parts in FIG. 3.

The motor case 32, as illustrated in FIG. 4, includes a front case 34 for being protrudingly formed with an annular protruder 34*a* at an inner periphery thereof, and a rear case 36 formed at one side thereof with a discharge outlet 36*a* for exhausting purified air discharged from the suction motor 30, and at the same time, formed at one side with a plurality of inward protruders 36*b* in order to inhibit rotation caused by inherent mobility during initial driving of the suction motor 30.

The front and rear cases 34 and 36 are fixedly fastened by such fastening means such as screws and the like.

Meanwhile, the suction motor 30 encased in an inner side of the motor case 32 is arranged at a front side thereof with a vibroisolating ring 38 closely inserted between the ring protruder 30*a* and the annular protruder 34*a* in order to absorb and prevent the vibration generated at the suction motor 30 from being transmitted to be motor case 32.

The suction motor 30 is disposed at a rear side thereof with a rear packing 40 whose inner side is inserted to a rear side of the suction motor 30 and whose external side is tightly engaged within the rear case 36.

The rear packing 40 is inserted at an exterior tip thereof into a recess in an inner side of the body 20.

Although the cross-sectional shape of the vibroisolating ring 38 is represented in the drawing as having a round cross-section, it should be noted that the cross-sectional shape is not limited to the given round shape but it can have a many-sided shape such as rectangle, hexagon or the like.

It should be also apparent that the vibroisolating ring 38 can be integrally and protrudingly formed at a front surface of the suction motor 30 or in an inner side of the front case 34 instead of as a separate individual object.

The rear packing is integrally constituted at an inner side thereof with a plurality of buffering covers 40*a* for being inserted onto an external side of the inward protruders 36*b* and for buffering impact generated during an initial driving of the suction motor 30.

Furthermore, the rear packing 40, rear case 36 and the body 20 are insertedly arranged with a support ring 42 for the same to be closely contacted thereamong. The support ring 42 can now inhibit transmission to the body 20 of small vibration transferred from the suction motor 30 and the rear case 36.

Meanwhile, the front case is insertedly and tightly provided at an other side thereof with a front packing 46 having an inserted arrangement of a buffering plate 44, so that even small minute vibration transmitted from the suction motor 30 to the front case 34 can be absorbed and inhibited from being transmitted to the body 20.

The body 10 of the vacuum cleaner is connected at one side thereof to a suction hose 50 through the intermediary of a connecting tube 48. A handle 52 connected to a tip of the suction hose 50 is connected through the intermediary of an extension tube 54 to a suction inlet 56 for absorbing foreign objects such as dust and the like.

Unexplained reference numeral 58 of the drawing represents a cord reel for enabling withdrawing an extension cord, and reference numerals 60*a* and 60*b* denote wheels.

Next, operation and effect therefrom with regard to the vibroisolating apparatus of a vacuum cleaner will be described according to one embodiment of the present invention thus constituted.

First of all, a strong suction force is generated in the body 20 of the vacuum cleaner according to the operation of the suction motor 30, and at this time, the suction force generated therefrom absorbs dust and the like along with the air through suction inlet 56.

The foreign objects such as dust and the like absorbed in through the suction inlet 56 are induced into the dust collecting chamber 24 through the connecting tube 54 and the suction hose 50, and the foreign objects such as dust and the like sucked into the dust collecting chamber 24 are stored in the dust collecting pocket 26. The air which has passed the dust collecting pocket 26 passes through the filtering member 28 to thereafter be changed to purified air and to be absorbed into the suction motor 30.

At this time, the minute fine dust and the like which has passed the dust collecting pocket 26 cannot pass through the filtering member 28 and thereby is stored in the dust collecting chamber 24, and only the purified air which has passed the filtering member can be induced into the suction motor 30.

Then, the purified air sucked into the suction motor 30 is discharged into an inner side of the motor case 32 to thereafter be drained out through the discharge outlet 36*a*. The purified air is now discharged into the atmosphere through a discharge route (not shown) formed at the body 20 of the vacuum cleaner, so that the cleaning operation can be carried out.

Mean while, the vibration generated in the course of the operation of the suction motor 30 is absorbed and inhibited at the same time by the vibroisolating ring 38 and the rear packing 40 disposed at the front and rear surfaces of the suction motor 30, so that the vibration transmitted to the motor case 32 can be minimized.

The small vibrations transmitted to the motor case 32 are in turn absorbed and, at the same time, inhibited by the front and rear packings 46 and 40, and are not transmitted to the body 20 of the vacuum cleaner, which enables the vibration and noise to be minimized.

Since the front packing 46 is provided with the inside buffering plate 44, the vibration in the motor case 32 is absorbed and is not transmitted to the body 20 of the vacuum cleaner, so that generation of vibration and noise is reduced to a minimum for a quite silent operation thereof.

Furthermore, because the suction motor 30 is provided at an inner side thereof with a plurality of the inward protruders 26*b* through the intermediary of the buffering covers 40*a*, inherent turning effect and vibration generated in the initial operation of the suction motor 30 can be prevented.

As apparent from the foregoing, according to the vibroisolating apparatus of a vacuum cleaner, the motor case is provided at the front and rear surface sides thereof with a vibroisolating ring and a rear packing to fixedly arrange the suction motor, and at the same time, the motor case is supported in the body of the vacuum cleaner at both ends thereof by the front packing and the rear packing, so that the vibration generated in the suction motor is absorbed and inhibited by the vibroisolating ring, front and rear packings to thereby reduce the transmission of the vibration to a minimum, and also to decrease generation of noise resulting therefrom to a minimum for a quite silent operation of the vacuum cleaner.

Furthermore, there are other advantages in that a simple structure enables an easy assembly of components involved therein to thereby reduce manufacturing cost remarkably.

Figure 5:
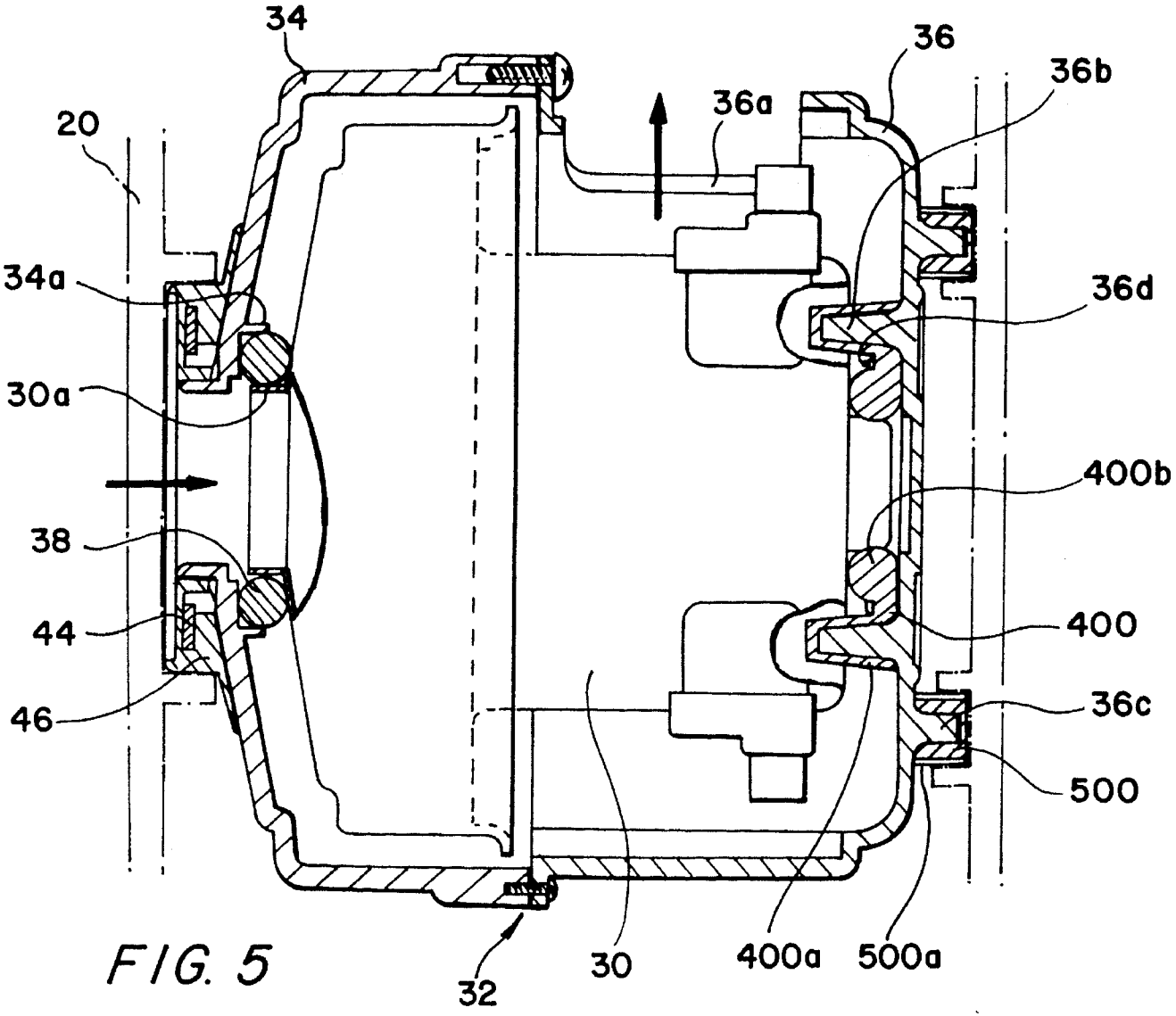
FIG. 5 is an enlarged sectional view of principal parts in another embodiment for a vibrosolating apparatus of a vacuum cleaner according to the present invention.
Figure 6:
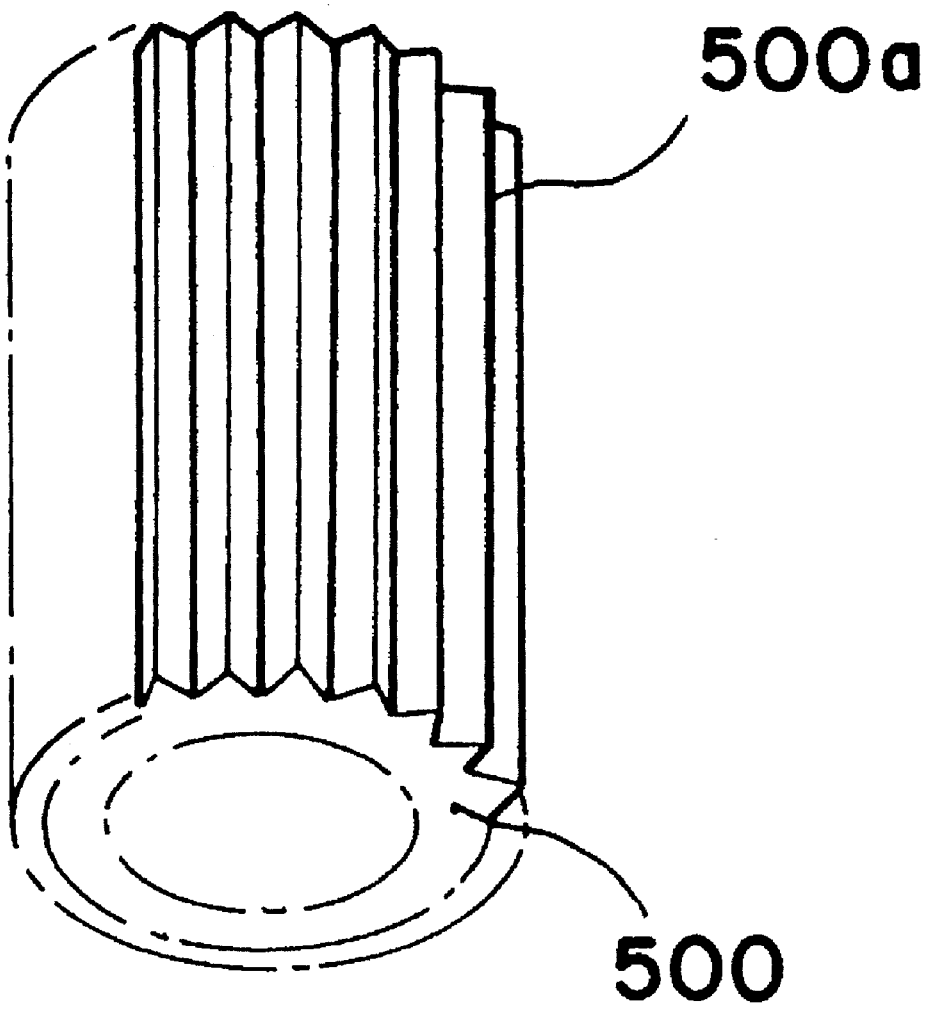
FIG. 6 is a perspective view of a buffering member of the embodiment shown in FIG. 5.

Meanwhile, FIGS. 5 and 6 represent another embodiment of the present invention wherein a rear surface packing 400 is integrally formed with a buffering cover 400*a* encompassing inward protruders protrudingly formed in an inner side of the rear case 36 and a buffering ring 400*b* disposed between the suction motor 30 and an inner side of the rear packing 36, so that the turning effect generated during activation of the suction motor can be prevented and at the same time, the vibration generated and thereafter transmitted to the rear case 36 in the course of the operation of the suction motor 30 can be absorbed and inhibited.

The rear case 36 is protrudingly formed at an external side thereof with a plurality of outward protruders 36*c*, which in turn are disposed within buffering member 500 formed at an external side thereof with a plurality of buffering protruders 500*a*, as illustrated in FIG. 6.

The buffering member 500 is constituted to be insertedly fixed within the body 20 to thereby support the motor case 32.

The rear packing 400 is supported by a plurality of support protruders 36*d* protrudingly formed in an inner side of the rear case 36.

Consequently, according to the preferred embodiments of the present invention, the vibration generated in the suction motor 30 is absorbed and inhibited at a front side thereof by the vibroisolating ring 38 and the front packing 46 and is sucked in and interdicted at a rear side thereof by the rear packing 400 and the buffering members 500, so that the vibration to be transmitted to the body 20 is reduced to a minimum and the noise generated therefrom is decreased to a minimum for a quite silent operation of the vacuum cleaner.

Furthermore, a simple construction and easy assembling works markedly reduce the manufacturing cost of the vacuum cleaner, and more particularly the noise in the low frequency range, i.e., in the range of 300 Hz–600 Hz, can be all the more reduced to a minimum.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A vacuum cleaner which includes a vibroisolating apparatus comprising:

a suction motor adapted to be mounted within a vacuum cleaner body to generate suction force, said motor having a front surface and a rear surface;

a motor case disposed about the suction motor;

a vibroisolating ring provided at the front surface of the suction motor and a rear surface packing provided at the rear surface of the suction motor to absorb and inhibit vibrations generated by the suction motor from being transmitted to the motor case; and a front surface packing arranged at an external front surface of the motor case to absorb and inhibit vibrations from being transmitted to the body of the vacuum cleaner, said front surface packing being provided at an inner surface of the packing with a buffering plate for buffering impact forces resulting from vibration of the suction motor.

2. A vibroisolating apparatus for a vacuum cleaner comprising:

a suction motor adapted to be mounted within a vacuum cleaner body to generate suction force, said motor having a front surface and a rear surface;

a motor case disposed about the suction motor;

a vibroisolating ring provided at the front surface of the suction motor and a rear surface packing provided at the rear surface of the suction motor to absorb and inhibit vibrations generated by the suction motor from being transmitted to the motor case, wherein the motor case comprises a front case formed with an annular protrusion for supporting the vibroisolating ring, and a rear case adapted to be fastened to the front case and formed at one side thereof with a discharge outlet for discharging absorbed air; and a front surface packing arranged at an external front surface of the motor case to absorb and inhibit vibrations from being transmitted to the body of the vacuum cleaner.

3. A vibroisolating apparatus for a vacuum cleaner as defined in claim 2, wherein the rear surface packing is provided with buffering covers and wherein, the rear case is provided with a plurality of inward extending protrusions adapted to be inserted into the buffering covers to prevent rotation of the motor with respect to the motor case.

4. A vibroisolating apparatus for a vacuum cleaner as defined in claim 1, wherein the vibroisolating ring is a many-sided shape.

5. A vibroisolating apparatus for a vacuum cleaner as defined in claim 2, further comprising a buffering member wherein the rear case is provided with a plurality of outward protrusions adapted to be inserted into the buffering covers to prevent transmission of vibrations to the vacuum cleaner body.

6. A vibroisolating apparatus for a vacuum cleaner as defined in claim 5, wherein the buffering member is formed at a periphery thereof with a plurality of buffering protrusions.

7. A vibroisolating apparatus for a vacuum cleaner comprising:

a suction motor adapted to be mounted within a vacuum cleaner body to generate suction force, said motor having a front surface and a rear surface;

a motor case disposed about the suction motor;

a vibroisolating ring provided at the front surface of the suction motor and a rear surface packing provided at the rear surface of the suction motor to absorb and inhibit vibrations generated by the suction motor from being transmitted to the motor case, wherein the rear surface packing is integrally formed with a buffering cover for being inserted over an external side of inward extending protrusions on the rear case and with a buffering ring for being tightly adhered to the suction motor; and a front surface packing arranged at an external front surface of the motor case to absorb and inhibit vibrations from being transmitted to the body of the vacuum cleaner.

8. A vibroisolating apparatus for a vacuum cleaner as defined in claim 2, wherein the front and rear cases are integrally formed at inner sides thereof with front and rear buffering members.

* * * * *